US005782379A

United States Patent [19]

Traub et al.

[11] Patent Number: 5,782,379

[45] Date of Patent: Jul. 21, 1998

[54] ARTIFICIAL FINGERNAIL DISPENSING DEVICE

[75] Inventors: JoAnn M. Traub, West Warrick, R.I.; Craig C. Selvage, Attleboro, Mass.

[73] Assignee: Hasbro, Inc., Pawtucket, R.I.

[21] Appl. No.: 598,888

[22] Filed: Feb. 8, 1996

[51] Int. Cl.[6] ..... B65G 59/00

[52] U.S. Cl. ..... 221/93; 221/97; 221/131; 221/24; 221/232; 221/195; 221/281; 221/282; 132/73; 132/285

[58] Field of Search ..... 221/93, 95, 97, 221/131, 24, 232, 191, 195, 281, 282; 132/73, 75, 285, 333

[56] References Cited

U.S. PATENT DOCUMENTS

| | | | |
|---|---|---|---|
| 479,820 | 8/1892 | Little | 221/24 |
| 1,719,826 | 7/1929 | Aldrich | 221/131 |
| 2,239,040 | 4/1941 | Holmes . | |
| 2,393,371 | 1/1946 | Harris | 132/73 |
| 2,467,085 | 4/1949 | Gildone . | |
| 2,688,331 | 9/1954 | Bogoslowsky . | |
| 3,242,930 | 3/1966 | Wilner | 221/131 |
| 3,485,344 | 12/1969 | Aylott | 132/73 |
| 4,471,885 | 9/1984 | Mucciarone | 221/232 |
| 4,648,416 | 3/1987 | Kilman et al. | 132/73 |
| 4,690,303 | 9/1987 | Draper et al. | 221/195 |
| 4,974,610 | 12/1990 | Orsini . | |
| 5,036,589 | 8/1991 | Heinrich . | |
| 5,133,369 | 7/1992 | Billings . | |
| 5,244,116 | 9/1993 | Leo . | |
| 5,302,224 | 4/1994 | Jenkins et al. . | |

*Primary Examiner*—H. Grant Skaggs
*Attorney, Agent, or Firm*—Kurt R. Benson

[57] ABSTRACT

A device for dispensing and holding artificial fingernails for decoration includes a housing having an upper work platform, and a plurality of magazine assemblies disposed within the housing. Each of the magazine assemblies includes a body for storing a plurality of artificial fingernails in stacked relation, and a spring biased plunger disposed in the body for urging the artificial fingernails upwardly within the body. The device further includes a slide having a plurality of slide members which are slidable through the respective magazine bodies for engaging the rear edge of the uppermost fingernail in each of the magazine assemblies and advancing the fingernail outwardly through an exit opening in the body of each of the magazine assemblies. The exit openings are disposed on the upper work surface of the work platform. Furthermore, each of the exit openings includes a dependent holder for releasably holding the advanced artificial fingernail with the upper surface of the advanced fingernails exposed for decoration. More specifically, the holder comprises a channel with a bottom wall for supporting the fingernail and side walls for frictionally capturing the side edges of the fingernail. The work surface further includes ornamental surface features in the form of two hands laid palm down on the work platform. The holders are disposed at the ends of the fingers of the hands so that the advanced fingernails are exposed for decoration in the normal fingernail position on each of the fingers.

6 Claims, 7 Drawing Sheets

ARTIFICIAL FINGERNAIL DISPENSING DEVICE

BACKGROUND AND SUMMARY OF THE INVENTION

The instant invention relates to toys, and more particularly to a toy which is operable for dispensing and holding a plurality of artificial fingernails for decoration by a child.

Artificial fingernails, and various methods of creating and decorating artificial fingernails, as well as real fingernails, are well known in the art. In this regard, the U.S. Pat. Nos. to Gildone 2,467,085; Bogoslowsky 2,688,331; and Orsini 4,974,610 disclose various known means and methods of decorating fingernails. While the known devices and methods are effective for their intended purpose, i.e. the preparation, decoration and application of artificial fingernails for use by adults, the heretofore known fingernail products are generally not suitable for use by children. Since it is well known in the toy art that toys and devices which effectively and realistically simulate adult activities have significant play value, it is believed that a toy which effectively simulates the activity of decorating artificial fingernails would have significant play value for young girls.

Accordingly, the instant invention provides a toy device which is operative for dispensing and holding a plurality of artificial fingernails for decoration by a child. The device comprises a housing having an upper work platform and a plurality of fingernail magazine assemblies disposed within the housing. Each of the magazine assemblies includes a body for storing a plurality of artificial fingernails in stacked relation, and a spring biased follower disposed in the body for urging the stacked artificial fingernails upwardly within the magazine body. The device further includes a slide assembly having a plurality of slide members which are slidable through the respective magazine bodies for engaging the uppermost fingernail in each of the magazine assemblies and advancing the uppermost fingernail outwardly through an exit opening in the body of each of the magazine assemblies. The exit openings are disposed on the upper work surface of the work platform wherein each of the exit openings includes a holder for releasably holding the advanced artificial fingernail. More specifically, the holder comprises a channel with a bottom wall for supporting the fingernail and side walls for frictionally capturing the side edges of the fingernail such that the upper surface of the advanced fingernail is exposed for decoration. The work surface further includes ornamental surface features in the form of a pair of hands laid palm down on the work platform. The fingernail holding structures at the exit openings of the magazine assemblies are positioned at the ends of the simulated fingers of the pair of simulated hands so that the advanced fingernails are held in the normal fingernail position on each of the simulated fingers. The arrangement of the simulated hands, and artificial nails at the ends of the simulated fingers effectively recreates the activity of giving a manicure to the hands.

In use of the device, the slide assembly is operative for advancing the uppermost artificial fingernail of each of the magazine assemblies into their respective holders wherein the upper surfaces of the fingernails are exposed for decoration in the normal fingernail position on the simulated hands. The operator may then paint and decorate the artificial nails, as if they were performing a manicure on the simulated hands. Thereafter, the artificial fingernails may be individually removed from the holders, or alternatively, actuation of the slide assembly will advance a new set of nails into the holders and automatically dispense all of the decorated nails onto the work surface of the device. Once the artificial fingernails are removed from the device they can be applied over natural fingernails by means of a double sided adhesive tape.

Accordingly, among the objects of the instant invention are: the provision of a device for dispensing and holding an artificial fingernail for decoration; the provision of a toy for dispensing and holding a plurality of artificial fingernails for decoration by a child; the provision of such a device wherein the housing simulates a manicure pad and includes a pair of simulated hands positioned on top of the pad; and the provision of such a device wherein the artificial fingernails are advanced into an exposed position in which they are held in normal fingernail positions on the ends of simulated fingers.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE PREFERRED EMBODIMENT

Figure 1:
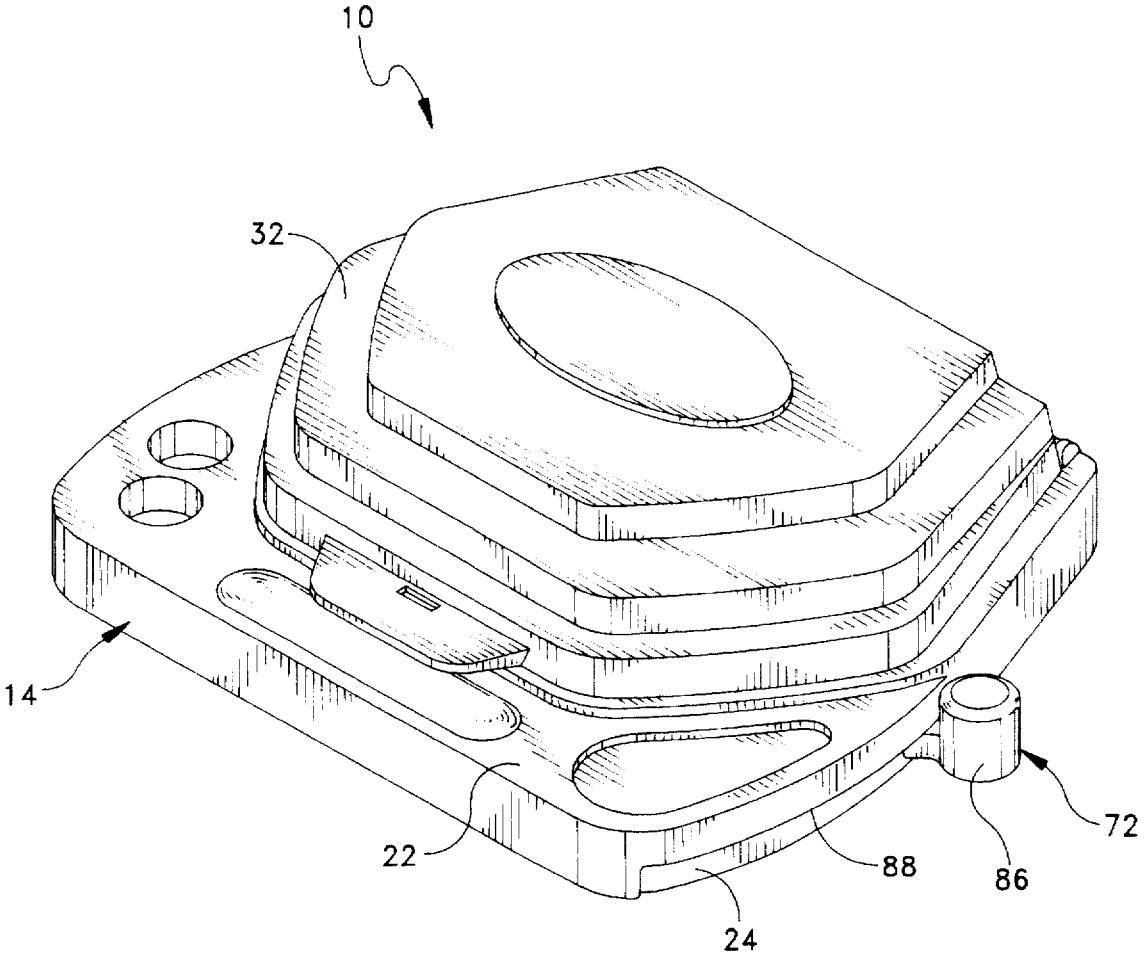
FIG. 1 is a perspective view of the artificial fingernail dispensing device of the instant invention.
Figure 2:
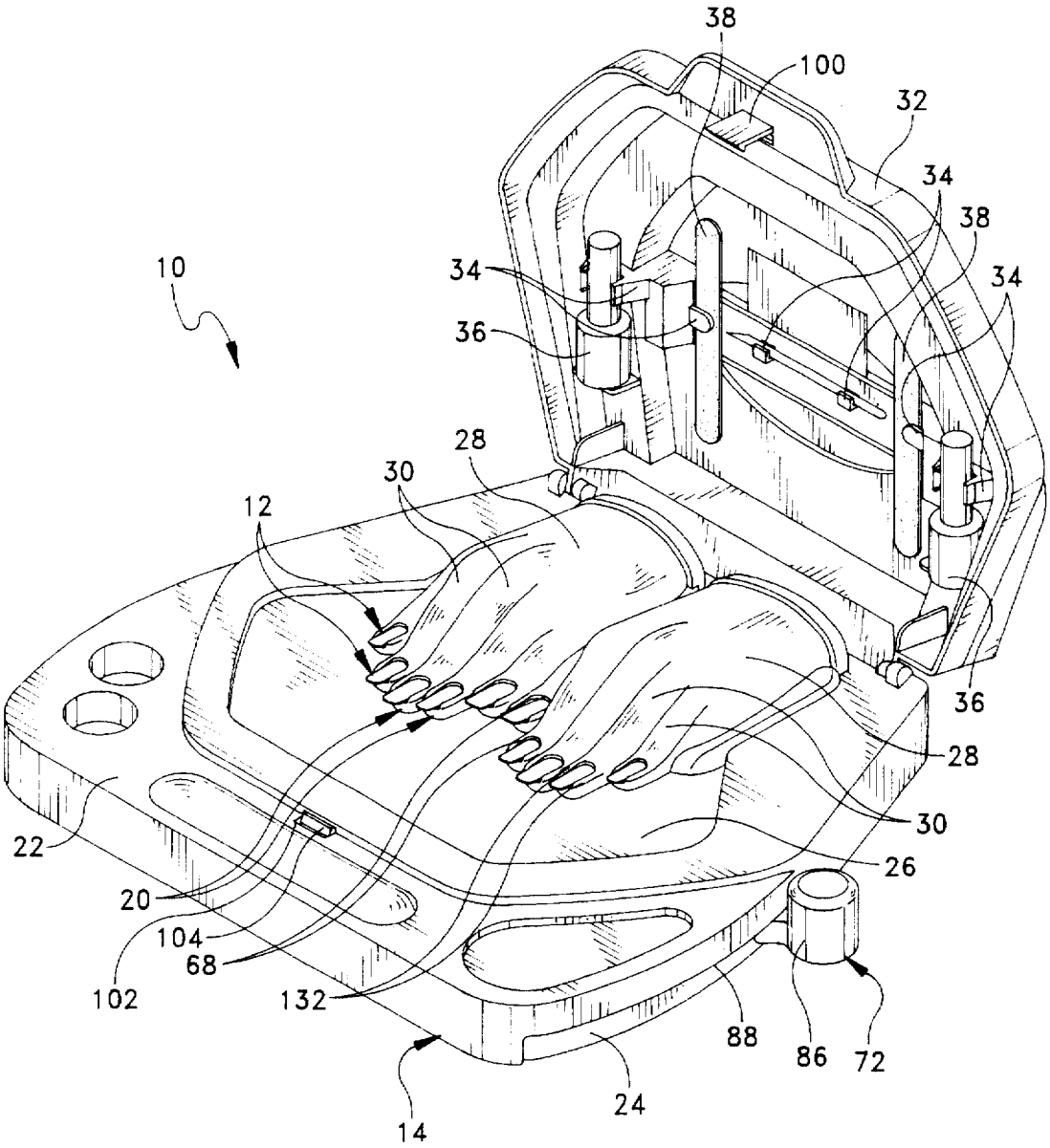
FIG. 2 is another perspective view thereof with a cover portion thereof lifted upwardly to expose the simulated hands positioned on the upper work platform of the housing.
Figure 3:
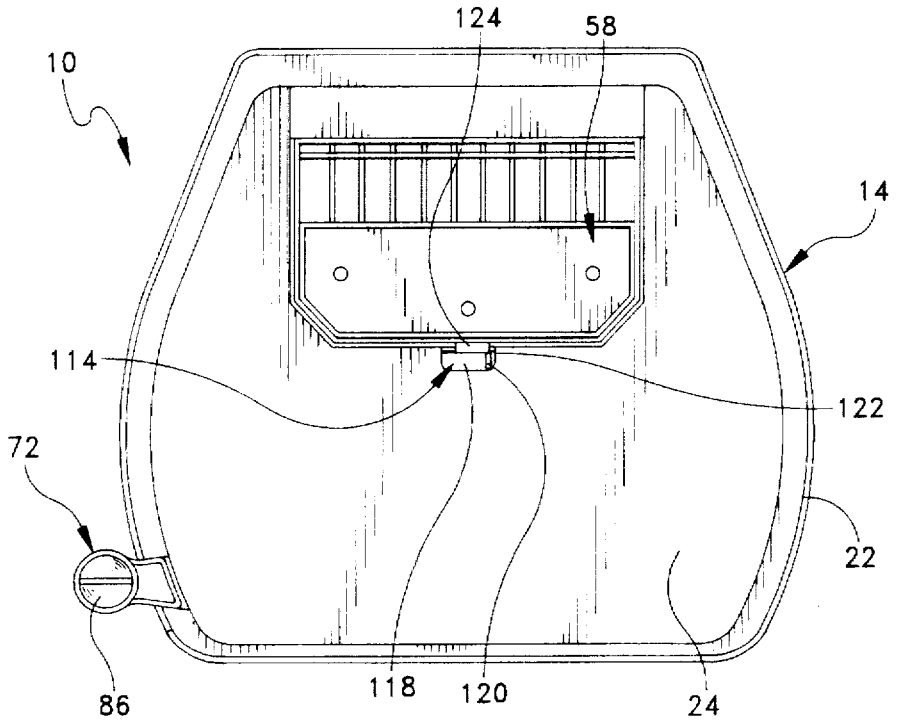
FIG. 3 is a bottom view of the device.

Referring now to the drawings, the artificial fingernail dispensing device of the instant invention is illustrated and generally indicated at 10 in FIGS. 1–13. As will hereinafter be more fully described, the instant fingernail dispensing device 10 is specially designed for use by a small child, and in this regard, the device 10 is operative for dispensing and holding a plurality of artificial fingernails generally indicated at 12 for decoration by a child.

The device 10 comprises a housing generally indicated at 14, a plurality of magazine assemblies generally indicated at 16 disposed within the housing 14 for storing the artificial fingernails 12, a slide assembly generally indicated at 18 for advancing the artificial fingernails 12 outwardly from the magazine assemblies 16, and a plurality of holding structures generally indicated at 20 for holding the advanced artificial fingernails 12 with the upper surfaces thereof exposed for decoration. The device 10 may be provided with stickers and other ornamental decorating items for decorating the artificial fingernails 12.

The housing 14 comprises upper and lower housing sections 22, 24 respectively, which are received and secured in interfitting relation by a plurality of threaded fasteners (not shown). The upper housing section 22 includes an upper work platform 26 shaped in the form of a manicure pad. The upper work platform 26 further includes ornamental surface features in the form of a pair of simulated hands 28 laid palm down on the manicure pad. As will be described in further detail hereinafter, the artificial fingernails 12 are advanced outwardly of the housing 14 into the fingernail holding structures 20 formed at the ends of the simulated fingers 30 of the hands 28. The housing 14 further includes a cover member 32 hingeably mounted on pins (not shown) to the upper housing section 22 for receipt over the simulated hands 28 and working surface 26 when the device 10 is not in use. The inside surface of the cover member 32 is provided with a plurality of spaced arms 34 for snap receiving various working articles, such as a bottle of nail polish 36, and fingernail files 38.

Figure 4:
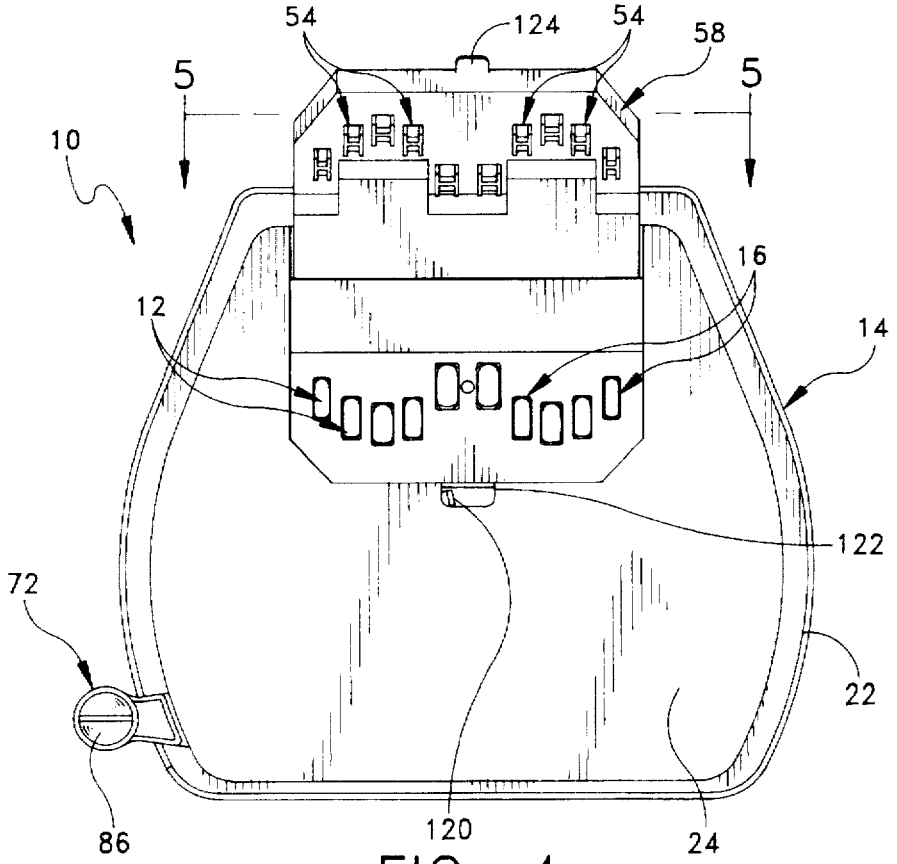
FIG. 4 is another bottom view with the nail compartment door opened.
Figure 5:
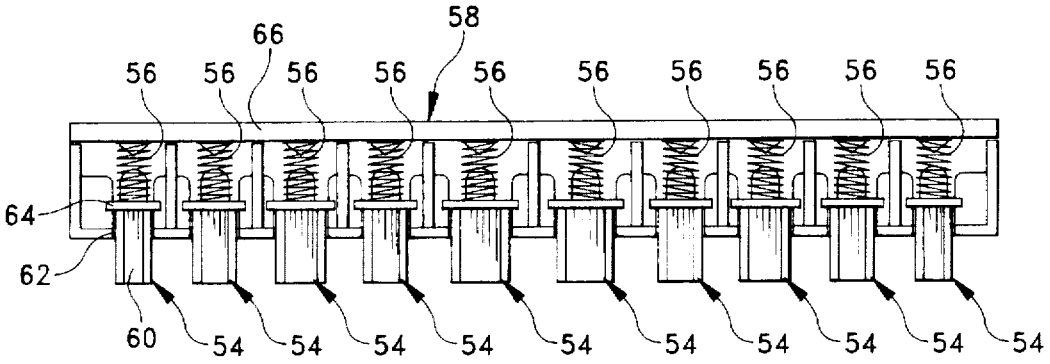
FIG. 5 is a cross-sectional view of the nail compartment door taken along line 5—5 of FIG. 4.
Figure 6:
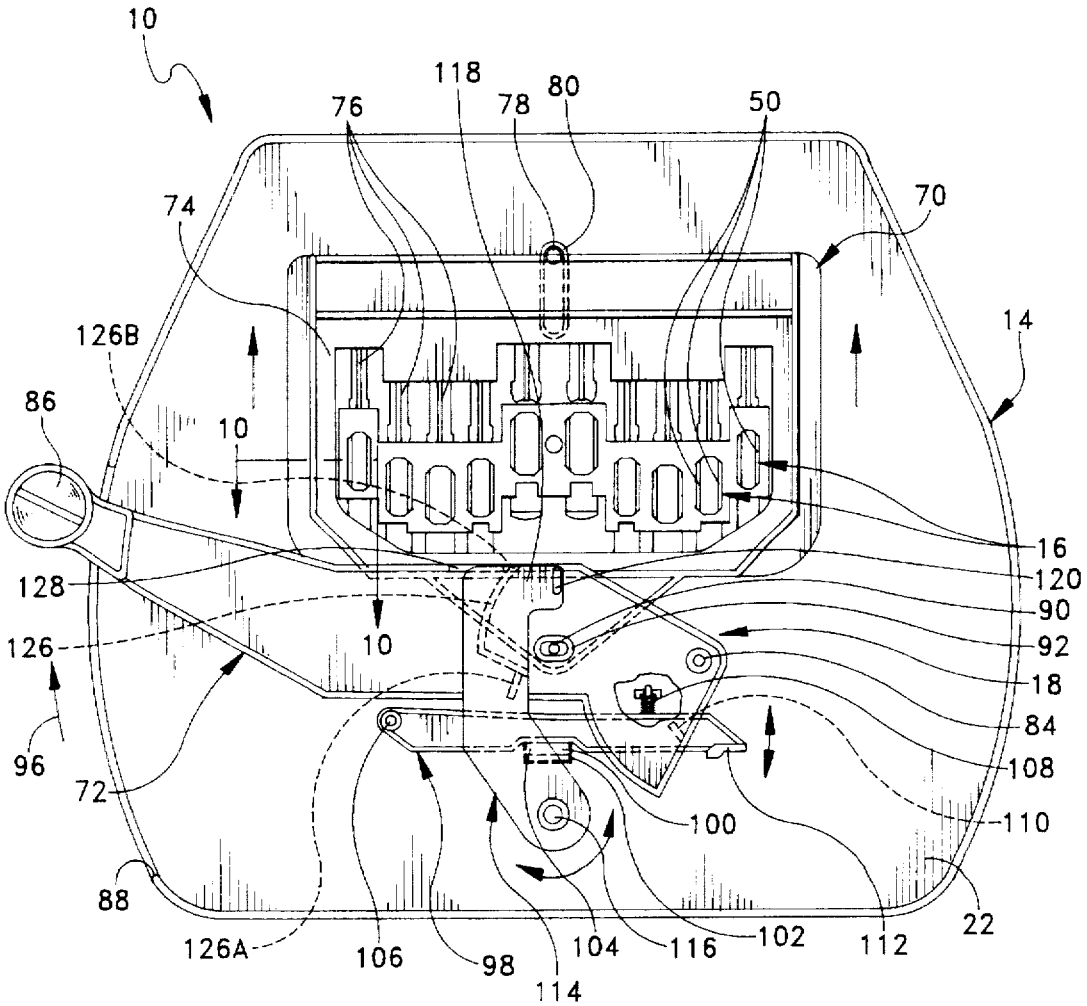
FIG. 6 is a bottom elevational view of the device with the lower housing section removed for purposes of illustration.
Figure 7:
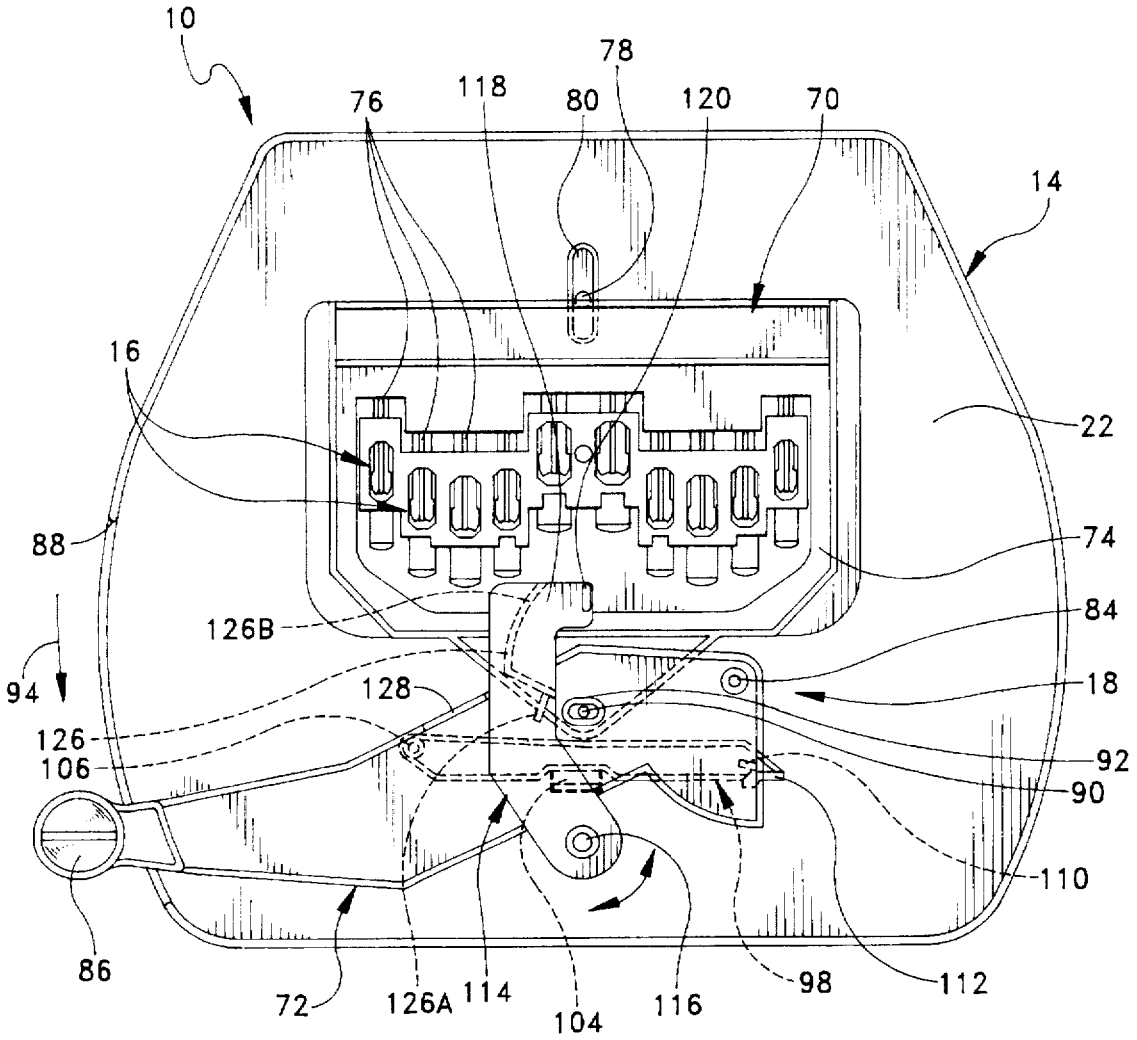
FIG. 7 is a similar view illustrating movement of the slide apparatus.
Figure 8:
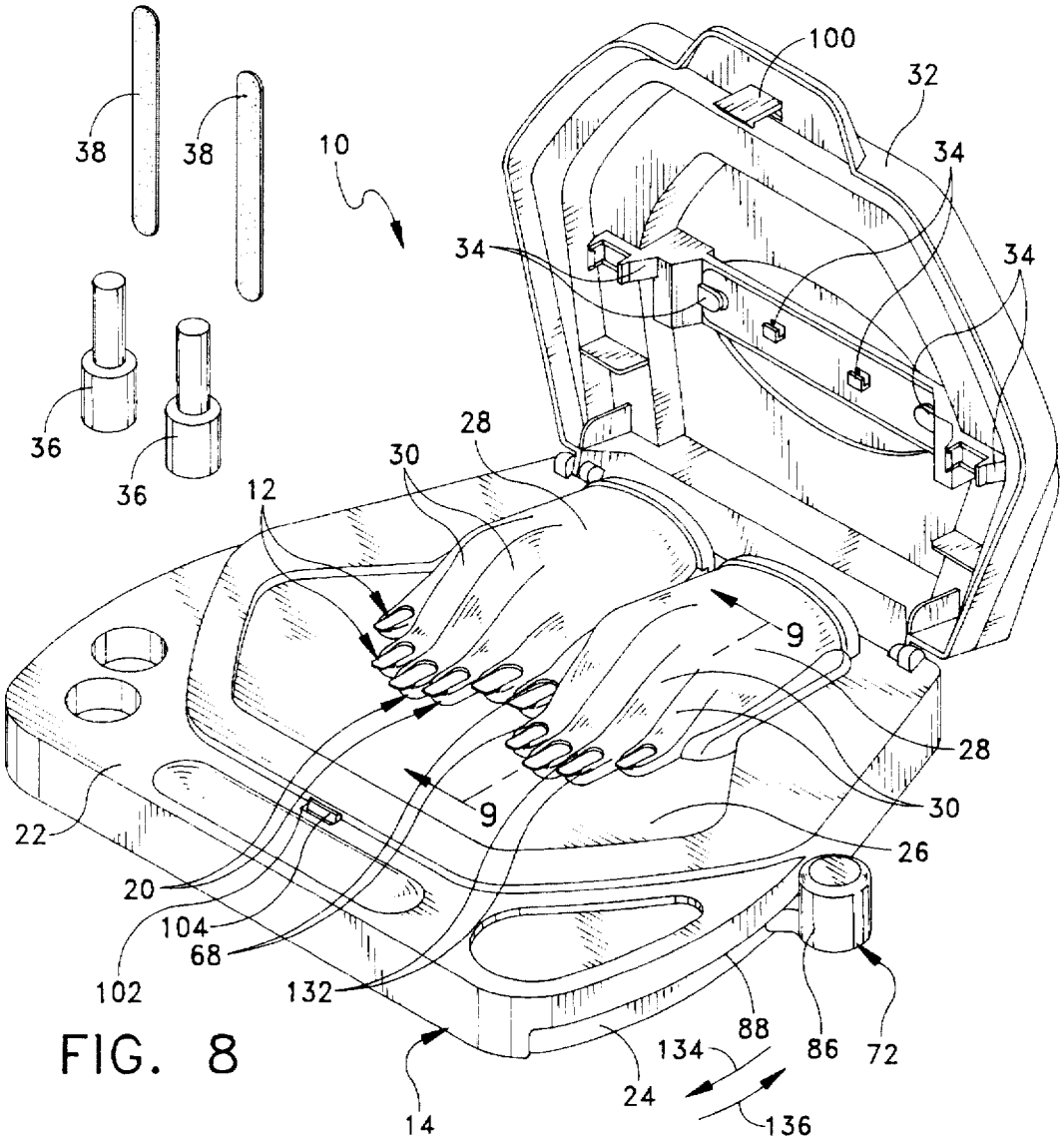
FIG. 8 is an exploded perspective view of the device showing the component articles for decoration of the artificial nails.
Figure 9:
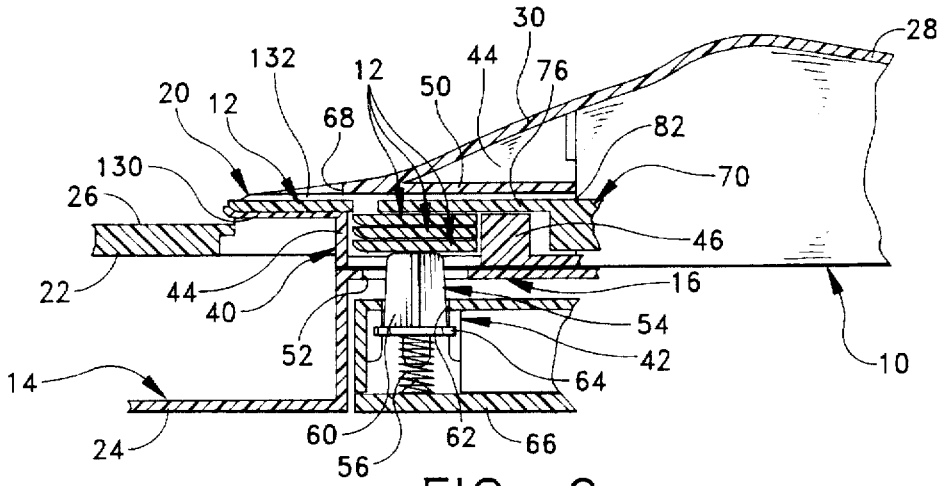
FIG. 9 is a cross-sectional view of the housing taken along line 9—9 of FIG. 8.
Figure 10:
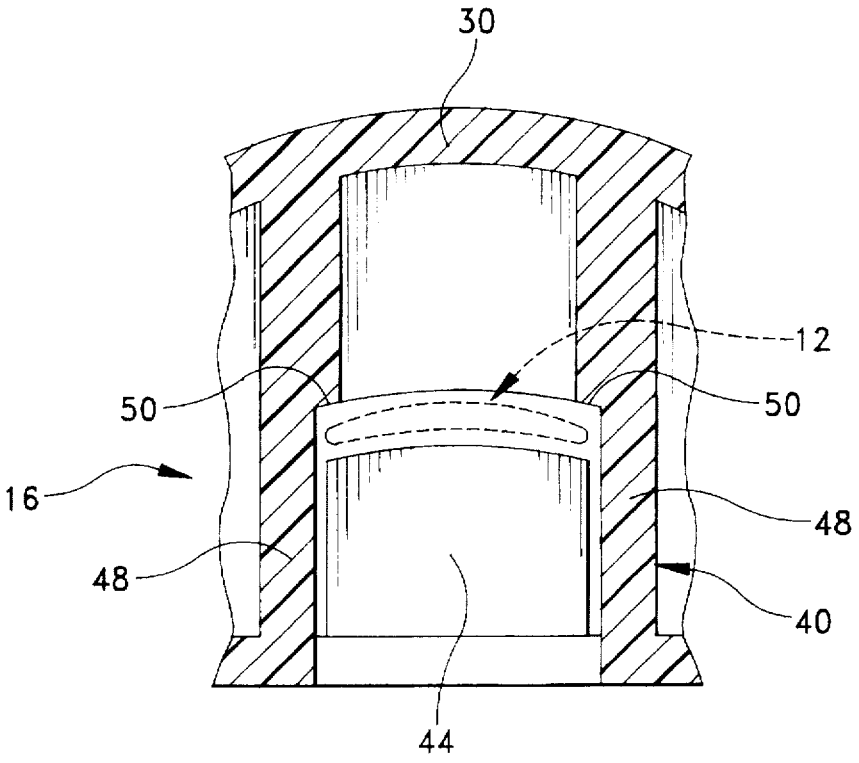
FIG. 10 is another cross-sectional view of the housing taken along line 10—10 of FIG. 6.
Figure 11:
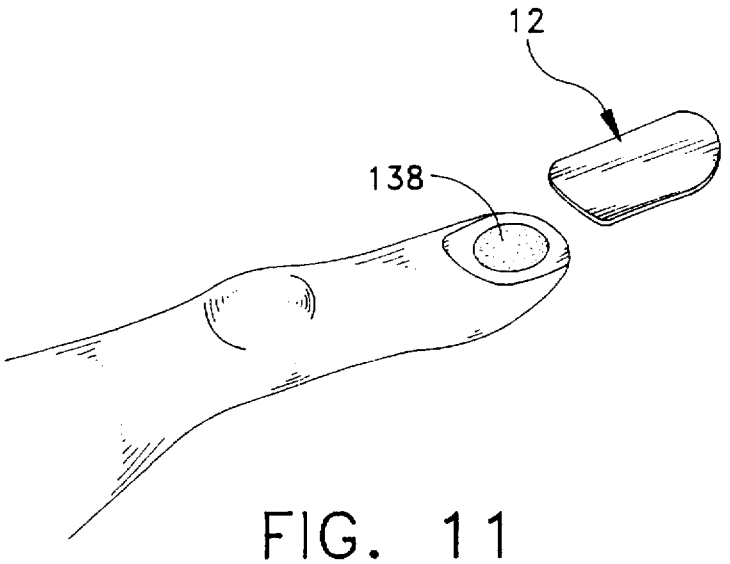
FIG. 11 is a perspective view of a finger showing application of one of the decorated artificial fingernails to a natural fingernail by means of a double-sided adhesive tape pad.

Each of the magazine assemblies 16 includes a body generally indicated at 40 for storing a plurality of artificial fingernails 12 in stacked relation, and a spring biased follower assembly generally indicated at 42 disposed within the body 40 for urging the artificial fingernails 12 upwardly within the body 40 (See FIGS. 9 and 10). More specifically, each magazine body 40 comprises front, back and side wall portions 44, 46, and 48 respectively which are integrally formed with the lower surface of the upper work platform 26 just rearwardly of the fingernail ends of the simulated fingers 30 (See FIG. 9). While there is no top wall to the magazine body 40, upward movement of the fingernails 12 in the magazine bodies 40 is arrested by inwardly tapered formations 50 on the side walls 48 of the body 40 (See FIG. 10). The bottom of the magazine body 40 is open for loading of the artificial fingernails 12 into the magazine 16 through an opening 52 in the lower housing section 24, and for receipt of the respective spring biased follower assembly 42 which comprises a plunger element generally indicated at 54 and a spring 56 mounted in a door member generally indicated at 58 hingeably secured to the lower housing section 24 (See FIGS. 4–5). The plunger elements 54 include a finger portion 60 which extends outwardly through a respective opening 62 in the upper surface of the door member 58, and a flange 64 which prevents the plunger element 54 from escaping through the opening 62. The spring 56 is captured between the bottom flange 64 of the plunger element 54 and the lower surface 66 of the door member 58 to bias the plunger element 54 to a normally extended position (FIG. 5). The door member 58, with its plurality of spring biased plunger elements 54, is arranged on the lower housing section 24 directly beneath the plurality of magazine assemblies 16 wherein each of the plunger elements 54 is received within the open bottom of the body 40 of a respective magazine assembly 16 to urge the stacked artificial fingernails 12 upwardly within the magazine body 40 (See FIG. 9).

The slide assembly 18 is operative for advancing the uppermost fingernail 12 in each of the magazine assemblies 16 outwardly through an exit opening 68 in the front wall 44 of the magazine body 40. More specifically, the slide assembly 18 comprises a slide generally indicated at 70 which is slidably mounted in the housing 14, and an actuator lever generally indicated at 72. The slide 70 has a rectangular frame body portion 74, and a plurality of slide members 76. The body portion 74 is received adjacent the lower surface of the upper work platform 26, and it is guided for sliding movement by a guide pin 78 formed on the upper surface of the body portion 74. The guide pin 78 rides in a channel 80 formed on the lower surface of the upper work platform 26. The slide members 76 of the slide 70 are received adjacent to the rear walls 46 of respective magazine assemblies 16 wherein they are slidable through entrance openings 82 (FIG. 9) in the rear wall 46 of the respective magazine bodies 40 for engaging the uppermost fingernail 12 in each of the magazine assemblies 16 and advancing the uppermost fingernail 12 outwardly through the exit opening 68 in the magazine assemblies 16. In this regard, the slide 70 is movable between a first position (FIG. 6) wherein the slide members 76 are positioned to the rear of the magazine assemblies 16, and a second position (FIG. 7) wherein the slide members 76 are extended through the magazine bodies 40. Movement of the slide 70 is actuated by the actuator lever 72 which is rotatably mounted on a pivot pin 84 secured to the lower surface of the upper work platform 26. The lever 72 includes a handle end 86 which extends outwardly through a slot 88 in the side wall of the housing 14. The slide 70 is pivotably connected to the actuator lever 72 at a point intermediate the outer handle 86 and the inner pivot pin 84 by a second pivot pin 90 mounted to the slide 70. The pin 90 extends upwardly from an appendage of the slide 70 and extends through a slot 92 formed in the actuator lever 72. Accordingly, it can be seen that forward movement of the handle 86 (See arrow 94 FIG. 7) causes movement of the slide 70 from the first position to the second position, and rearward movement of the handle 86 (See arrow 96 FIG. 6) causes movement of the slide 70 from the second position back to the first position.

Referring to FIGS. 3–8, the device 10 further includes two latching members which are integrally operable with the actuator lever 72. The device 10 includes a first latching member generally indicated at 98 for latching and maintaining the upper cover member 32 in a closed position. In this regard, a tab element 100 at the extreme front of the cover member 32 extends through an opening 102 in the upper housing section 22 and engages with a detent 104 on the front surface of the latching member 98. The latching member 98 is pivotally mounted to the upper housing section 22 by a pin 106 and is normally biased into engagement with the tab element 100 by a spring 108. Accordingly, the tab 100 is normally engaged by the detent 104 on the latching member 98 for maintaining the cover member 32 closed. However, the tab element 100 can be easily disengaged from the detent 104 by minimal upward pressure on the cover 32 to overcome the spring force applied by the biasing spring 108. It is further pointed out that a ridge 110 (broken lines) on the underside of the actuator lever 72 (See FIGS. 6 and 7) engages with a terminal end 112 of the latching member 98 when the actuator lever 72 is in the second position (FIG. 7) to prevent movement of the latching member 98 and lifting of the cover member 32. However, when the actuator lever 72 is moved back to the first position, the ridge 110 is disengaged from the latching member 98, and the cover 32 is free to be opened.

The second latching member is generally indicated at 114 and is operative for maintaining the bottom door 58 in the closed position. The second latching member 114 is pivotally mounted to the upper housing section on a post 116, and it includes a terminal end portion 118 with an upwardly extending tab 120. The terminal end portion 118 of the second latching member 114 is receivable through an opening 122 formed on the lower housing section 24 wherein the terminal end portion 118 is pivotably movable to overlap a tab 124 formed on the forward edge of the bottom door 58. It is noted that the second latching member 114 is only movable when the actuator lever 72 is in the second position (See FIG. 7). In this regard, the underside of the second latching member 114 includes a ridge element 126 which interacts with a ridge 128 extending upwardly from the upper side of the actuator lever 72. When the actuator lever 72 is in the second position (FIG. 7), the second latching member 114 is free to rotate counterclockwise until a lower leg portion 126A of the ridge 126 engages with ridge 128. However, when actuator lever 72 is moved back to the first position, an upper leg portion 126B of ridge 126 affirmatively engages the ridge 128 and prevents movement thereof.

Referring now to FIG. 9, the exit openings 68 of the magazine bodies 40 are positioned on the upper surface of the work platform 26 wherein each of the exit openings 68 merges into a holder structure 20 for releasably holding the advanced artificial fingernail 12. More specifically, the holder 20 comprises a channel formed by a bottom wall 130 which supports the fingernail 12 and side walls 132 for frictionally capturing the side edges of the fingernail 12. In this manner, the upper surface of the advanced fingernail 12 is exposed for decoration. More specifically, the fingernail holding structures 20 at the exit openings 68 of the magazine assemblies 16 are positioned at the ends of the simulated fingers 30 of the hands 28 so that the channels are disposed at the normal fingernail positions on the simulated fingers 30. In this regard, the side walls 132 are formed by physical structures which resemble the folds of skin that would surround a natural fingernail on a real hand. Accordingly, when the fingernails 12 are advanced out of the magazines 16, the fingernails 12 are held in the holding structures 20 in the normal fingernail positions on each of the simulated fingers 30.

Before the device 10 can be operated, a plurality of artificial fingernails 12 must be loaded into the respective magazines 16. Loading of the fingernails 12 is accomplished by flipping the housing 14 over so that the back of the device 10 faces the user (FIG. 3), and moving the actuator lever 72 into the second position. This locks the cover member 32 closed, moves slide members 76 into position inside the magazine bodies 40, and frees the second latching element 114 for movement. The second latching member 114 is then moved counterclockwise to open the bottom door 58, and the artificial fingernails 12 are inserted upside-down into each of the magazine bodies 40 (FIG. 4). When the magazine bodies 40 are full, the door 58 is closed, the latch 114 moved back into position, and the actuator lever 72 is moved back to the first position to lock the latching member 114 and door 58 in the closed position. The device 10 is then flipped over for normal use.

In use, the slide assembly 18 is operative for advancing the uppermost artificial fingernail 12 of each of the magazine assemblies 16 into their respective holders 20 wherein the upper surfaces of the fingernails 12 are exposed for decoration in the normal fingernail position on the simulated hands 28. More specifically, referring to FIGS. 8 and 9, a set of fingernails 12 is advanced into the holders 20 by moving the actuator lever 72 from the first position to the second position (arrow 134), and then returning the lever back to the first position (arrow 136). This motion drives the slide members 76 through the magazine bodies 40, engaging the rear edge of the uppermost fingernail 12 and advancing the front end of the fingernail 12 outwardly through the exit opening 68 into the holding structure 20 (FIG. 9). The operator may then paint and decorate the artificial nails 12 as if they were performing a manicure on the simulated hands 28. Thereafter, the artificial fingernails 12 may be individually removed from the holders 20 by simply pulling the fingernail 12 forwardly out of the respective holder 20, or alternatively, actuation of the slide assembly 18 a second time will advance a new set of fingernails 12 into the holders 20 and automatically dispense all of the decorated fingernails 12 onto the work surface 26 of the device 10. Once the artificial fingernails 12 are removed from the device 10 they can be applied over natural fingernails by means of a double sided adhesive tape pad 138(See FIG. 11).

It can therefore be seen that the instant invention provides a novel and effective toy device 10 for dispensing and holding a plurality of artificial fingernails 12 for decoration by a child. The housing structure 14 resembles an actual manicuring pad to realistically recreate that the child is giving a manicure to a person. Furthermore, the simulated hands 28 on the work surface 26 further enhance the perception that the fingernails 12 are actually the fingernails of the simulated hands 28. When the decoration of the fingernails 12 is complete, the fingernails 12 can be removed for application to the operator's hands, further increasing the play value of the device. The unique arrangement of the magazine assemblies 16 and slide assembly 18 permits the operator to easily advance new sets of artificial fingernails 12 into position for decoration. Furthermore, the holding structures 20 of the magazines 16 are integrally incorporated into the simulated hands 28 so that he artificial fingernails 12 appear as the fingernails of the simulated hands 28. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A device for dispensing and holding artificial fingernails for decoration comprising:

a magazine assembly including a body for storing a plurality of artificial fingernails in stacked relation, and spring biased follower means in the body for urging the artificial fingernails upwardly within the body;

advancing means for advancing a forward end of an uppermost artificial fingernail outwardly through an exit opening in said body, said advancing means comprising a slide member which engages a rear end of the uppermost artificial fingernail, said slide member being slidably movable through said body to advance said uppermost artificial fingernail outwardly through said exit opening; and means adjacent to the exit opening for releasably holding said advanced artificial fingernail so that the upper surface of said advanced artificial fingernail can be decorated, said means for holding said advanced artificial fingernail comprising an upwardly open channel extending outwardly from said exit opening, said channel including a bottom wall for supporting a lower side of said artificial fingernail and two spaced side walls for frictionally engaging opposing side edges of said advanced fingernail whereby the upper surface of the advanced fingernail remains exposed for decoration.

2. A device for dispensing and holding artificial fingernails for decoration comprising:

a housing including a work platform;

a plurality of magazine assemblies disposed within the housing, each of said magazine assemblies including a body for storing a plurality of artificial fingernails in stacked relation, and spring biased follower means in the body for urging the artificial fingernails upwardly within the body;

advancing means for advancing a forward end of an uppermost artificial fingernail in each of said magazine assemblies outwardly through an exit opening the body of each of said magazine assemblies, said exit openings being disposed above the upper surface of the work platform, said advancing means comprising a slide disposed within said housing, said slide including a plurality of slide members which respectively engage a rear end of the uppermost artificial fingernail in each of said magazine assemblies, said slide members being slidably movable through the bodies of said magazine assemblies to advance said uppermost artificial fingernails outwardly through said exit openings; and means adjacent to said exit openings on said work platform for releasably holding each of said advanced artificial fingernails so that the upper surface of said advanced artificial fingernails can be decorated, said means for holding each of said advanced artificial fingernails comprising a plurality of upwardly open channels extending outwardly from said exit openings, said channels each including a bottom wall for supporting a lower side of said artificial fingernail and two spaced side walls for frictionally engaging opposing side edges of said advanced fingernail whereby the upper surface of the advanced fingernail remains exposed for decoration.

3. The device of claim 2 wherein said work platform includes ornamental surface features in the shape of a pair of human hands laid palm down upon the work platform, and further wherein the upwardly open channels for holding the artificial fingernails are disposed at the terminal ends of finger portions of said hand features such that when the artificial fingernails are advanced through the exit openings they are positioned in the channels and comprise fingernail portions of each of the fingers.

4. The device of claim 2 wherein said housing further includes a bottom cover member releasably secured to a bottom portion of the housing, said cover member being arranged beneath said plurality of magazine assemblies, each of the bodies of the magazine assemblies having an open bottom, said spring biased follower means comprising a plunger element and a spring mounted within the bottom cover of the housing, each of said plunger elements being respectively received within the open bottom of said body of the respective magazine assembly, said spring normally biasing the plunger to an uppermost position to urge the fingernails received in the magazine body upwardly.

5. The device of claim 2 further comprising a cover means for covering the work platform when the device is not in use.

6. A device for holding and decorating an artificial fingernail comprising:

an imitation finger having a fingernail receiving recess thereon;

an artificial fingernail;

means in said recess for releasably receiving and retaining said artificial fingernail therein in a substantially natural fingernail position relative to said imitation finger during a fingernail decorating operations means for receiving and holding a plurality of said artificial fingernails; and means for sequentially advancing said artificial fingernails to said fingernail receiving recess so that sequential fingernails are individually received and retained therein by said releasable receiving and retaining means.

* * * * *